US006202606B1

(12) United States Patent
Anttila

(10) Patent No.: US 6,202,606 B1
(45) Date of Patent: Mar. 20, 2001

(54) AXIAL-PISTON ENGINE

(76) Inventor: Ahto Anttila, Pilvitie 2 A, Fin-00700 Helsinki (FI)

( * ) Notice: Subject to any disclaimer, the term of this patent is extended or adjusted under 35 U.S.C. 154(b) by 0 days.

(21) Appl. No.: 09/423,719

(22) PCT Filed: May 14, 1997

(86) PCT No.: PCT/FI97/00282

§ 371 Date: Nov. 12, 1999

§ 102(e) Date: Nov. 12, 1999

(87) PCT Pub. No.: WO98/51905

PCT Pub. Date: Nov. 19, 1998

(51) Int. Cl.[7] ..... F02B 75/18
(52) U.S. Cl. ..... 123/56.1; 123/56.2
(58) Field of Search ..... 123/56.1, 56.2, 123/56.3, 55.3

(56) References Cited

U.S. PATENT DOCUMENTS

| | | | | |
|---|---|---|---|---|
| 3,536,050 | | 10/1970 | Denis | 123/58 |
| 4,489,682 | * | 12/1984 | Kenny | 123/56.6 |
| 4,610,223 | * | 9/1986 | Karlan | 123/56.9 |
| 4,815,327 | | 3/1989 | Drevet | 74/60 |
| 4,886,024 | * | 12/1989 | Meredith | 123/56.5 |
| 5,452,689 | * | 9/1995 | Karlan | 123/56.2 |
| 5,950,580 | * | 9/1999 | Birckbichler | 123/56.2 |

FOREIGN PATENT DOCUMENTS

| | | |
|---|---|---|
| 1 810 808 | 7/1969 | (DE) . |
| 1 817 123 | 11/1970 | (DE) . |
| 0 225 834 A1 | 6/1987 | (EP) . |
| 1 304 180 | 1/1973 | (GB) . |

* cited by examiner

*Primary Examiner*—Tony M. Arganbright
*Assistant Examiner*—Jason Benton
(74) *Attorney, Agent, or Firm*—Connolly Bove Lodge & Hutz llp

(57) ABSTRACT

The invention relates to an axial-piston engine comprising a centrally located output shaft (1) and a plurality of piston-cylinder units (2) oriented parallel to the output shaft (1) and grouped symmetrically thereabout, a thrust yoke (5) mounted on said output shaft (1) so as to rotate therewith, said thrust yoke providing support to a tilted cam plate (4) mounted on bearings in a freely rotating manner on the perimeter of said thrust yoke (5), locking means (6, 7) for preventing the rotating of said tilted cam plate (4) with respect to the body of the engine and ball-jointed piston rods (9) connecting each piston (12)of the engine to said tilted cam plate (4) so as to transmit the sequential thrust of said pistons (12) tosaid tilted cam plate (4), thus effecting a rotational motion of said output shaft (1). According to the invention, the skirt of each piston (12) is provided with vanes (14) on which a force is exerted owing to an air vortex generated in the crankcase (3,3') by the nutating movement of the tilted cam plate (4) every time the skirt of the piston (12) travels outward from the bore of the cylinder (2), thus exerting a certain degree of axial rotation of the piston (12).

20 Claims, 3 Drawing Sheets

AXIAL-PISTON ENGINE

Figure 1:
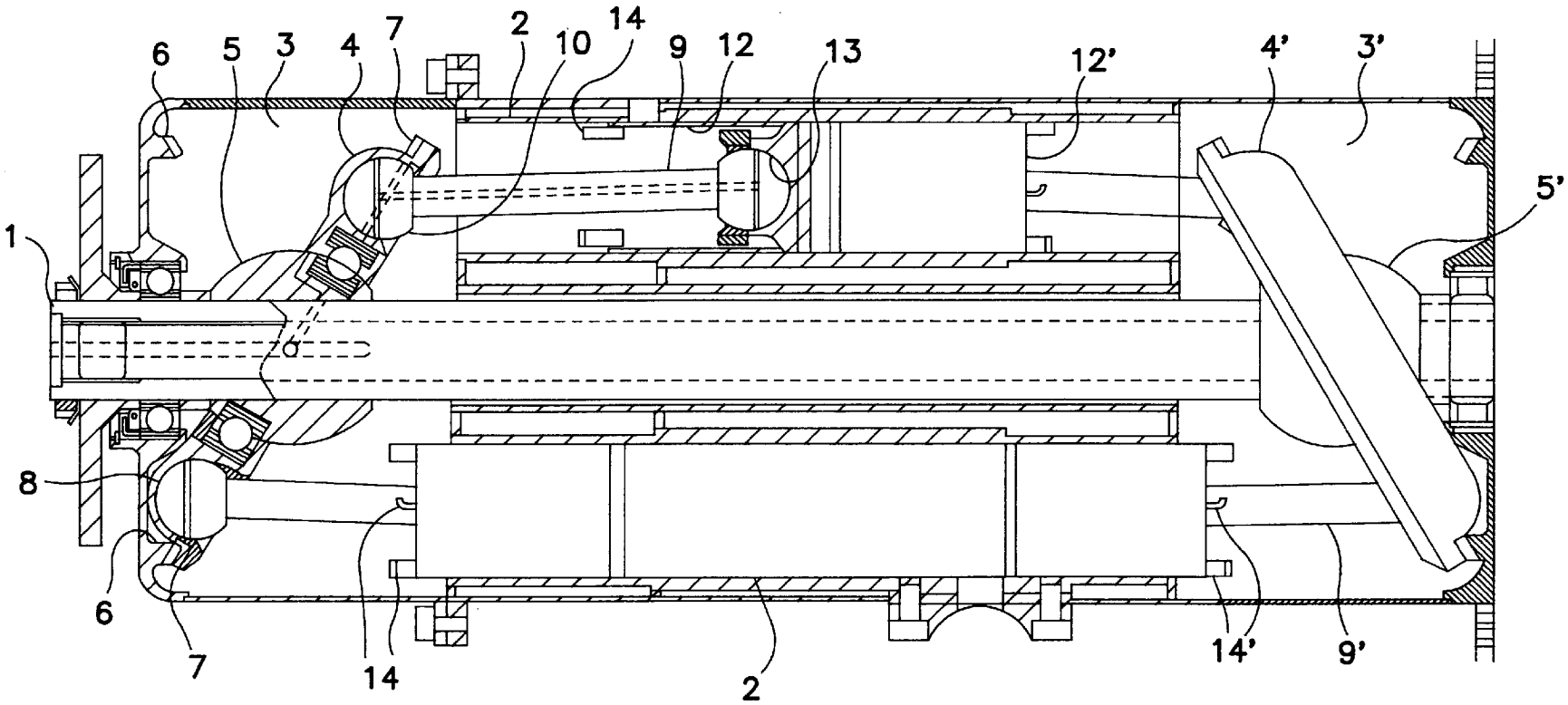

The present invention relates to an axial-piston engine comprising a centrally located output shaft and a plurality of piston-cylinder units oriented parallel to the output shaft and grouped symmetrically about said output shaft, a thrust yoke mounted on said output shaft so as to rotate therewith, said thrust yoke providing support to an tilted cam plate mounted on bearings in a freely rotating manner on the perimeter of said thrust yoke, locking means for preventing the rotation of said tilted cam plate with respect to the body of the engine and ball-jointed piston rods connecting each piston of the engine to said tilted cam plate so as to transmit the sequential thrust of said pistons to said tilted cam plate thus effecting a rotational motion of said output shaft.

Such an axial-piston engine is known from, e.g., DE laid-open publication no. 1,810,808. This prior-art axial-piston engine design has attempted to achieve maximally smooth running in order to minimize the wear of the engine's different parts. To this end, the end surface of the tilted cam plate is provided with a surface which in a running engine can be brought to perform a revolving contact with a countersurface provided on an interior end wall of the engine. While this arrangement achieves efficient stabilization of the tilted cam plate motion and a lower level of vibration in the engine, whereby the wear of the moving parts in the engine is reduced, it is handicapped by uneven wear of the pistons and ball joints that are forced to move over a constant trajectory. To overcome this drawback, said laid-open publication proposes a lubrication system of the piston rod and the tilted cam plate to be implemented by providing the ball-and-socket joint with a lubricant flow channel extending spirally along the spherical surface of the joint and exits obliquely at the piston rod. Such an arrangement aims at causing the exiting lubricant jet to exert some kind of reaction force which accomplishes a rotation of the piston rod. In this way some reduction of wear on the ball joint surfaces will be attained, but the wear due to the movement of the piston along the cylinder wall remains essentially unchanged. Furthermore, the performance of this implementation in practice remains somewhat questionable.

From other types of engines, alternative arrangements are known aiming to provide a cyclic rotational movement of the pistons during the running of the engine in order to reduce and equalize mutual wear between the piston and the cylinder. However, such a forced rotation requires equipping the engine with complex accessories that essentially increase the manufacturing costs of the engine.

It is an object of the present invention to achieve a reduction of wear problems in an axial-piston engine by virtue of a simple arrangement based on providing the skirt of each piston with vanes on which a force is exerted owing to a air vortex generated in the crankcase by the nutating movement of the tilted cam plate every time the piston skirt travels outward from the cylinder bore, thus exerting a certain degree of axial rotation of the piston. Such a rotation of the piston can be effected based on the fact that during the running of the engine, a strong air stream is generated flowing along the interior wall of the crankcase with a higher tangential velocity as compared to the air stream velocity in the center of the crankcase.

Other characterizing specifications of the invention will be evident from the annexed dependent claims.

Figure 2:
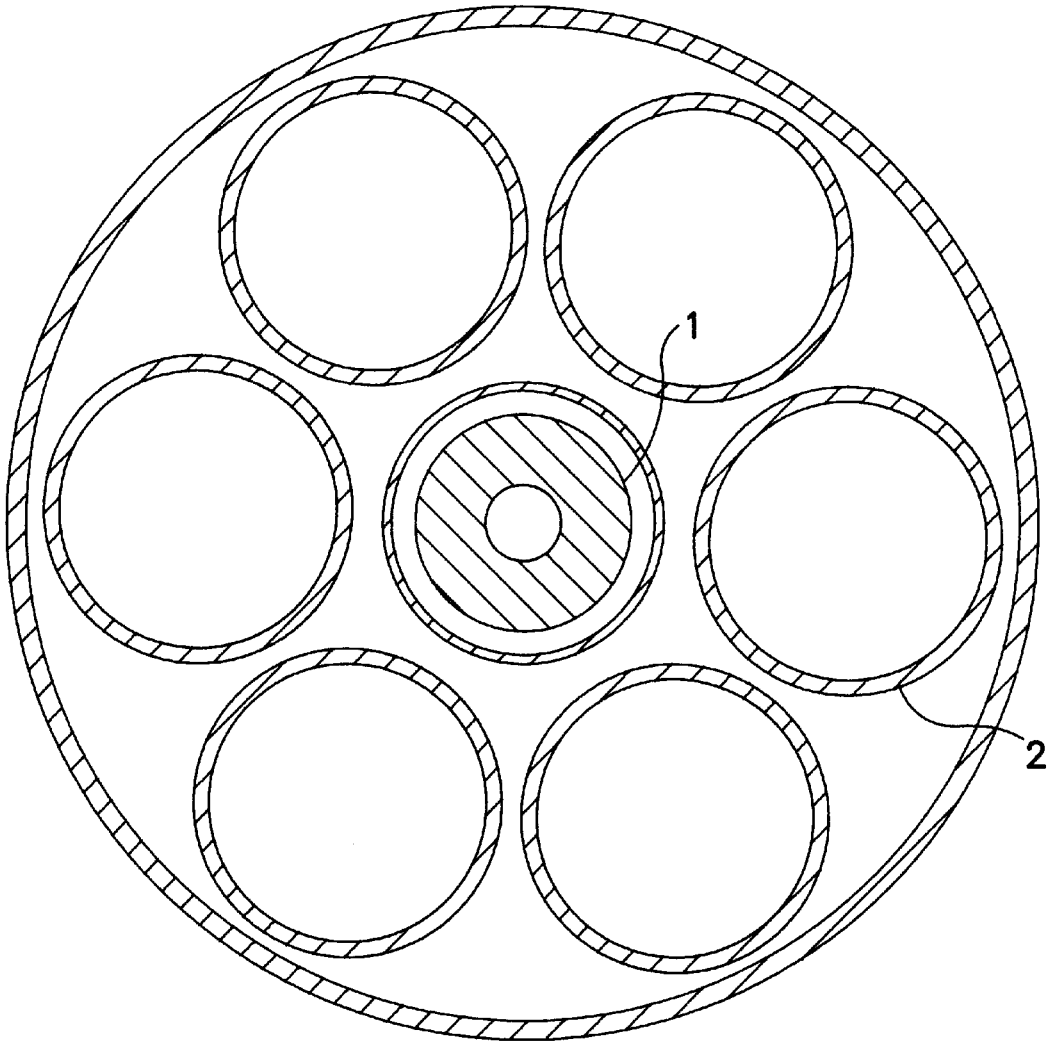
Figure 3:
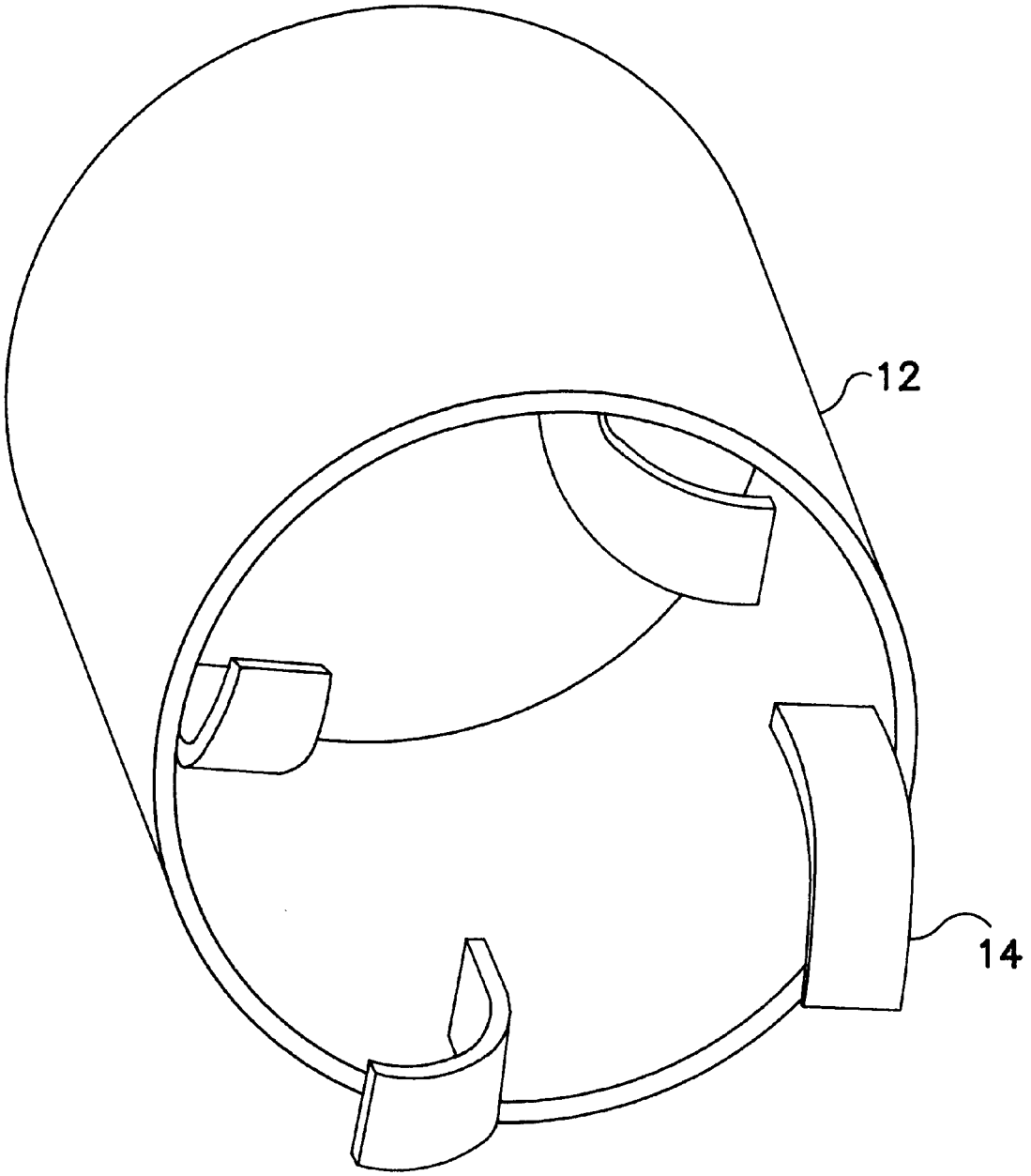

Next, the invention will be explained in greater detail with reference to the appended drawings in which FIG. 1 is a longitudinal section of an exemplifying embodiment of the axial-piston engine according to the invention;

FIG. 2 is a schematic illustration of the axial-piston engine in a cross-sectional view at the pistons; and FIG. 3 is an schematic illustration of the piston of the axial-piston engine in an enlarged perspective view.

Referring to the diagrams, the axial-piston engine according to the invention comprises a centrally located output shaft 1 and a plurality of piston-cylinder units 2 which are oriented parallel to the output shaft and are grouped symmetrically about said output shaft 1. As is evident from FIG. 2, the engine illustrated in the drawing has six piston-cylinder units 2. The piston-cylinder units 2 open into the engine crankcase 3, 3', wherein the output shaft 1 is provided with a thrust yoke 5 which rotates with said output shaft and acts as a support for a tilted cam plate 4. The cam plate 4 is mounted on the perimeter of the thrust yoke 5 on bearings in a freely rotating manner, which cam plate 4 is tilted at an oblique angle with respect to the output shaft 1 of the engine. The engine body and the peripheral area of the tilted cam plate 4 are provided with mutually cooperating means 6, 7 preventing the tilted cam plate 4 from rotating with respect to the engine body. The tilted cam plate is provided with a number of sockets 8 of ball joints corresponding to the number of cylinders in the engine, said sockets being intended to accommodate one ball end 10 of the piston rod 9 of each piston-cylinder unit 2 thus forming a ball-and-socket joint. The other ball end 11 of each piston rod 9 forms a similar ball-and-socket joint with a socket 13 adapted to each of the pistons 12. Hence, the piston rods 9 and the pistons 12, respectively, are freely rotatable about their axes independently from each other. Via the piston rods 9, the sequentially pulsating thrust force exerted by the pistons 12 is transmitted onto the tilted cam plate 4 thus forcing the output shaft 1 into a rotational motion. To prevent biased wear of the ball-and-socket joints and the cylinders, the skirt of each piston 12 is provided according to the invention with vanes 14 aligned to meet the air vortex, which is generated in the crankcase by the nutating movement of the tilted cam plate 4, every time the skirt of the piston 12 travels outward from the bore of the cylinder 2. By virtue of this air vortex acting on said vanes 14, each of the pistons 12 executes a certain degree of rotation simultaneously as the skirt of the respective piston 12 protrudes into the crankcase 3. Thence, scoring of the surfaces of the moving parts is avoided, which substantially reduces wear of the engine elements and essentially increases the life of the engine.

Advantageously, the vanes 14 are spaced equidistantly along the inner surface of the skirt of the piston 12 so as to extend downward from the piston bottom in essentially radially aligned planes. Because the intensity of the air vortex increases toward the perimeter of the interior wall of the crankcase 3, the desired rotational movement of the pistons 12 will occur even if the vanes 14 are made entirely planar. In order to achieve a stronger rotation effect, the vanes 14 can be given an essentially J-shaped form with the vanes 14 bent against the impinging air vortex, whereby the air vortex hits the vanes 14 more effectively in the tangential direction of the vortex and the aerodynamic resistance of the vane rotation in the same direction is reduced.

The axial-piston engine according to the invention may be a 2-or a 4-stroke otto or diesel engine, a compressor or a pump.

In a preferred embodiment, the means 6, 7 for preventing the rotation of the tilted cam plate 4 of the axial-piston engine comprises a first gear wheel 7 attached to the opposite side of the tilted cam plate 4 concentrically therewith and a second gear wheel 6 adapted on the opposite interior end wall of the engine body, concentrically with the engine output shaft 1, so as to cooperate with the first gear wheel in a manner permitting both gear wheels 6 and 7 to maintain a mutual mesh contact moving uninterruptibly on their perimeters. The gear wheel 7 of the tilted cam plate 4 makes a mesh contact with the gear wheel 6 of the engine body at a mesh point of the perimeters of the gear wheels 6, 7, where the perimeter of the tilted cam plate 4 is at its instantaneous most remote point from the cylinders.

The axial-piston engine shown in the drawings is of a so-called counterpiston type of engine in which each cylinder houses two opposedly operating pistons 12, whereby a combustion space is formed at the center point of each cylinder and both ends of the cylinder 2 open to an individual crankcase 3, 3'. Both crankcases 3, 3' house a tilted cam plate 4, 4' mounted in a freely rotating manner on the common output shaft 1 by means of a thrust yoke 5, 5', said tilted cam plates being symmetrically located with respect to the cross-sectional center plane of the engine.

To a person skilled in the art, it is obvious that the present invention is not limited by the above-described example of a counterpiston type of engine, but rather, can be applied to all types of axial-piston engines in which the reciprocating movement of the pistons is transformed into a rotational motion by means of a tilted cam plate adapted on the output shaft.

What is claimed is:

1. An axial-piston engine comprising a centrally located output shaft (1) and a plurality of piston-cylinder units (2) oriented parallel to and grouped symmetrically about said output shaft (1), a thrust yoke (5) mounted on said output shaft (1) so as to rotate therewith, said thrust yoke providing support to an tilted cam plate (4) mounted on bearings in a freely rotating manner on the perimeter of said thrust yoke (5), means (6, 7) for preventing the rotation of said tilted cam plate (4) with respect to the body of the engine, and ball-jointed piston rods (9) connecting each piston (12) of the engine to said tilted cam plate (4) so as to transmit the sequential thrust of said pistons (12) to said tilted cam plate (4) thus effecting a rotational motion of said output shaft (1), characterized in that the skirt of each piston (12) is provided with vanes (14) on which a force is exerted owing to an air vortex generated in the crankcase (3, 3') by the nutating movement of the tilted cam plate (4) every time the skirt of the piston (12) travels outward from the bore of the cylinder (2), thus exerting a certain degree of axial rotation of the piston (12).

2. An axial-piston engine as defined in claim 1, characterized in that the vanes (14) are spaced equidistantly along the inner surface of the skirt of the piston (12) so as to extend downward from the piston bottom in essentially radially aligned planes.

3. An axial-piston engine as defined in claim 2, characterized in that the part of said vanes (14) arranged to extend downward from the bottom of the piston (12) is given an essentially J-shaped form in order to improve the rotating effect imposed thereon.

4. An axial-piston engine as defined in claim 1, characterized in that said engine is an internal combustion engine.

5. An axial-piston engine as defined in claim 1, characterized in that said engine is a compressor.

6. An axial-piston engine as defined in claim 1, characterized in that said engine is a pump.

7. An axial-piston engine as defined in claim 1, characterized in that said means for preventing the rotation of said tilted cam plate (4) comprise a first gear wheel (7) attached to the opposite side of the tilted cam plate (4) concentrically therewith and a second gear wheel (6) adapted on the opposite interior end wall of the engine body, concentrically with the engine output shaft (1) so as to cooperate with the first gear wheel.

8. An axial-piston engine as defined in claim 1, characterized in that said engine is a counterpiston type of axial-piston engine, wherein each cylinder (2) houses two oppositely operating pistons (12, 12') that actuate tilted cam plates (4, 4') mounted at opposite ends of the engine on a common output shaft (1).

9. An axial-piston engine as defined in claim 2 wherein said engine is an internal combustion engine.

10. An axial-piston engine as defined in claim 3 wherein said engine is an internal combustion engine.

11. An axial-piston engine as defined in claim 2 wherein said engine is a compressor.

12. An axial-piston engine as defined in claim 3 wherein said engine is a compressor.

13. An axial-piston engine as defined in claim 2 wherein said engine is a pump.

14. An axial-piston engine as defined in claim 3 wherein said engine is a pump.

15. An axial-piston engine as defined in claim 2 wherein said means for preventing the rotation of said tilted cam plate comprise a first gear wheel attached to the opposite side of the tilted cam plate concentrically therewith and a second gear wheel adapted on the opposite interior end wall of the engine body, concentrically with the engine output shaft so as to cooperate with the first gear wheel.

16. An axial-piston engine as defined in claim 3 wherein said means for preventing the rotation of said tilted cam plate comprise a first gear wheel attached to the opposite side of the tilted cam plate concentrically therewith and a second gear wheel adapted on the opposite interior end wall of the engine body, concentrically with the engine output shaft so as to cooperate with the first gear wheel.

17. An axial-piston engine as defined in claim 4 wherein said means for preventing the rotation of said tilted cam plate comprise a first gear wheel attached to the opposite side of the tilted cam plate concentrically therewith and a second gear wheel adapted on the opposite interior end wall of the engine body, concentrically with the engine output shaft so as to cooperate with the first gear wheel.

18. An axial-piston engine as defined in claim 5 wherein said means for preventing the rotation of said tilted cam plate comprise a first gear wheel attached to the opposite side of the tilted cam plate concentrically therewith and a second gear wheel adapted on the opposite interior end wall of the engine body, concentrically with the engine output shaft so as to cooperate with the first gear wheel.

19. An axial-piston engine as defined in claim 6 wherein said means for preventing the rotation of said tilted cam plate comprise a first gear wheel attached to the opposite side of the tilted cam plate concentrically therewith and a second gear wheel adapted on the opposite interior end wall of the engine body, concentrically with the engine output shaft so as to cooperate with the first gear wheel.

20. An axial-piston engine as defined in claim 2 wherein said engine is a counterpiston type of axial-piston engine, wherein each cylinder houses two oppositely operating pistons that actuate tilted cam plates mounted at opposite ends of the engine on a common output shaft.

* * * * *